US010842234B2

(12) United States Patent
Allan

(10) Patent No.: US 10,842,234 B2
(45) Date of Patent: Nov. 24, 2020

(54) ILLUMINATED ACCESSORY

(71) Applicant: Alva Kenley Allan, Coral Springs, FL (US)

(72) Inventor: Alva Kenley Allan, Coral Springs, FL (US)

( * ) Notice: Subject to any disclaimer, the term of this patent is extended or adjusted under 35 U.S.C. 154(b) by 0 days.

(21) Appl. No.: 16/167,607

(22) Filed: Oct. 23, 2018

(65) Prior Publication Data

US 2019/0116942 A1 Apr. 25, 2019

Related U.S. Application Data

(60) Provisional application No. 62/576,323, filed on Oct. 24, 2017.

(51) Int. Cl.

| | |
|---|---|
| ***A44C 5/00*** | (2006.01) |
| ***A44C 15/00*** | (2006.01) |
| ***B26B 19/46*** | (2006.01) |
| ***B26B 19/38*** | (2006.01) |
| ***F21V 33/00*** | (2006.01) |

(52) U.S. Cl.

CPC ..... *A44C 5/0007* (2013.01); *A44C 5/0053* (2013.01); *A44C 15/0015* (2013.01); *B26B 19/3826* (2013.01); *B26B 19/46* (2013.01); *F21V 33/0004* (2013.01)

(58) Field of Classification Search

CPC . A44C 5/0007; A44C 15/0015; A44C 5/0053; B26B 19/3826; B26B 19/46; F21V 33/0004

See application file for complete search history.

(56) References Cited

U.S. PATENT DOCUMENTS

| | | | | |
|---|---|---|---|---|
| 2,279,341 | A | 4/1942 | Powell | |
| 2,669,648 | A | 2/1954 | Radcliff | |
| 2,914,655 | A | 11/1959 | Swift | |
| 5,970,616 | A | 10/1999 | Wahl et al. | |
| 6,578,982 | B1 * | 6/2003 | Lynch | A44C 15/0015 362/103 |
| 10,175,653 | B1 * | 1/2019 | Bloom | G04B 45/00 |
| 2008/0250645 | A1 | 10/2008 | Tringali et al. | |
| 2016/0109953 | A1 * | 4/2016 | Desh | G06F 3/017 345/169 |
| 2018/0000205 | A1 * | 1/2018 | Chinowsky | F21V 33/0008 |
| 2018/0020193 | A1 * | 1/2018 | Blum | G06F 1/1686 |
| 2018/0270931 | A1 * | 9/2018 | Kelly | A44C 15/00 |
| 2019/0098969 | A1 * | 4/2019 | Gibson | A44C 15/0015 |

* cited by examiner

*Primary Examiner* — Kevin Quarterman

(74) *Attorney, Agent, or Firm* — Boudwin Intellectual Property; Daniel Boudwin

(57) ABSTRACT

An illuminated accessory. The illuminated accessory includes a housing that may be elastic, a power source inside the housing, electric lights connected to the power source, and a power switch to control the electric lights and/or other components of the illuminated accessory, such as a camera, a microphone, a clock, and/or a timer. The illuminated accessory may be configured to wrap around a wrist of an individual and worn as a bracelet, and/or may be configured to wrap around a device, such as a hair trimmer, and used as a light source when performing an activity, such as trimming hair.

1 Claim, 6 Drawing Sheets

ILLUMINATED ACCESSORY

CROSS REFERENCE TO RELATED APPLICATIONS

This application claims the benefit of U.S. Provisional Application No. 62/576,323 filed on Oct. 24, 2017. The above identified patent application is incorporated by reference herein in its entirety to provide continuity of disclosure.

BACKGROUND OF THE INVENTION

The present invention relates to an illuminated accessory as a source of artificial light to facilitate performance of an activity by an individual, a machine, and/or a device.

Additional light is often required when performing activities. Existing solutions that provide artificial light include a light bulb, or a small set of light bulbs that are relatively close together, as may be found in a flashlight or headlamp. These devices often create shadows relative to a perspective of a user of the devices, and often require the user to hold or support the device during use, which may be difficult or cumbersome for many, especially during activities that require hand-eye coordination and attention to detail, such as hair trimming.

Therefore, there is a need in the art for an illuminated accessory as a source of light for performing an activity. The present invention addresses this unmet need.

Devices have been disclosed in the art that relate to sources of artificial light. These include devices that have been patented and published in patent application publications. However, these devices are often unsatisfactory or difficult to use. In view of the devices disclosed in the art, it is submitted that there is a need in the art for an improvement to existing sources of artificial light. In view of the present disclosure, it is submitted that the present invention substantially diverges in structural and functional elements from devices, systems, and methods in the art, and substantially fulfills an unmet need in the art.

SUMMARY OF THE INVENTION

In view of the disadvantages inherent in the known types of artificial light sources in the art, the present invention provides an illuminated accessory, wherein the same can be utilized for as a source of artificial light for performing an activity.

It is therefore an object of the present invention to provide an illuminated accessory.

In one aspect, the invention provides an illuminated accessory, comprising: a housing, a power source disposed in the housing, and a plurality of electric lights attached to the housing, wherein the plurality of electric lights is operably connected to the power source by an electrical connection; and a power switch configured to actuate the electrical connection.

In some embodiments, the housing is circular, and a circumference of the housing is proportionate to a circumference of at least one item selected from a group including, but not limited to: a hair trimmer, and a wrist of an individual. In some embodiments, the illuminated accessory further includes at least one item, connected to the housing, selected from a group including, but not limited to: a clock, a timer, a camera, a microphone, and a combination thereof.

The illuminated accessory may be useful for any application in which a particular level of light of a particular color or combination of colors is necessary, including but not limited to: using or repairing machines or devices, camping, hiking, stargazing, dark room activities (e.g., controlling or limiting light-sensitive film exposure while enabling the individual to handle any necessary equipment and navigate the dark room), or social or celebratory activities, including attending a bar or restaurant, attending a club, attending a sporting event, hunting, or night fishing.

In particular embodiments, the housing of the illuminated accessory is elastic. Due to its elastic nature, the illuminated accessory may also be capable of being relatively compact, and able to be stored in a pocket, a glove box, a bag, a purse, a backpack, or any other article or container as needed for retrieval and use in any situation, such as an emergency situation, an armed conflict situation, or any other setting or situation disclosed or contemplated herein or known or contemplated in the art.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
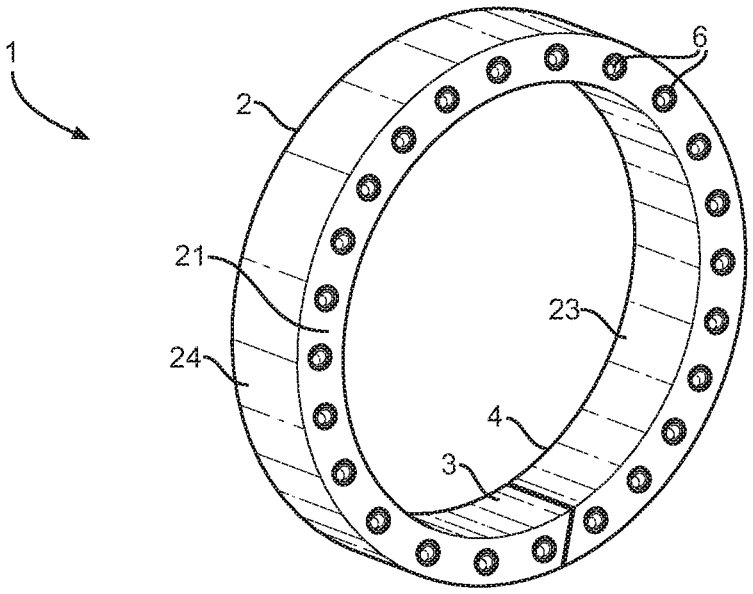
FIG. 1 depicts a front perspective view of an exemplary first embodiment of an illuminated accessory, having a plurality of electric lights configured to emit light from a forward and a rearward side of the housing.
Figure 2:
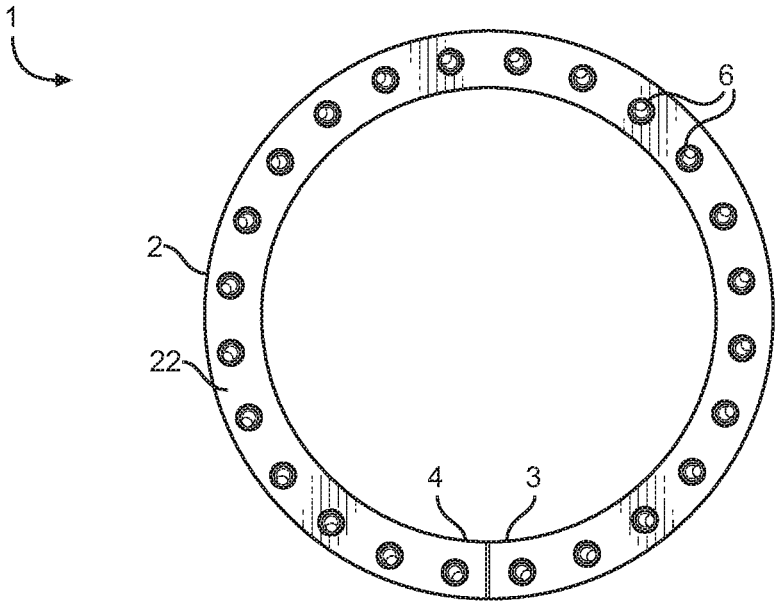
FIG. 2 depicts a rear view of the exemplary first embodiment of the illuminated accessory, wherein the plurality of electric lights is also configured to emit light from a rearward side of the housing.

Reference is made herein to the attached drawings. Like reference numerals are used throughout the drawings to depict like or similar elements of the invention. The figures are intended for representative purposes only and should not be considered limiting in any respect.

Reference is now made to the drawings, which depict one or more exemplary embodiments of the invention.

Figure 11:
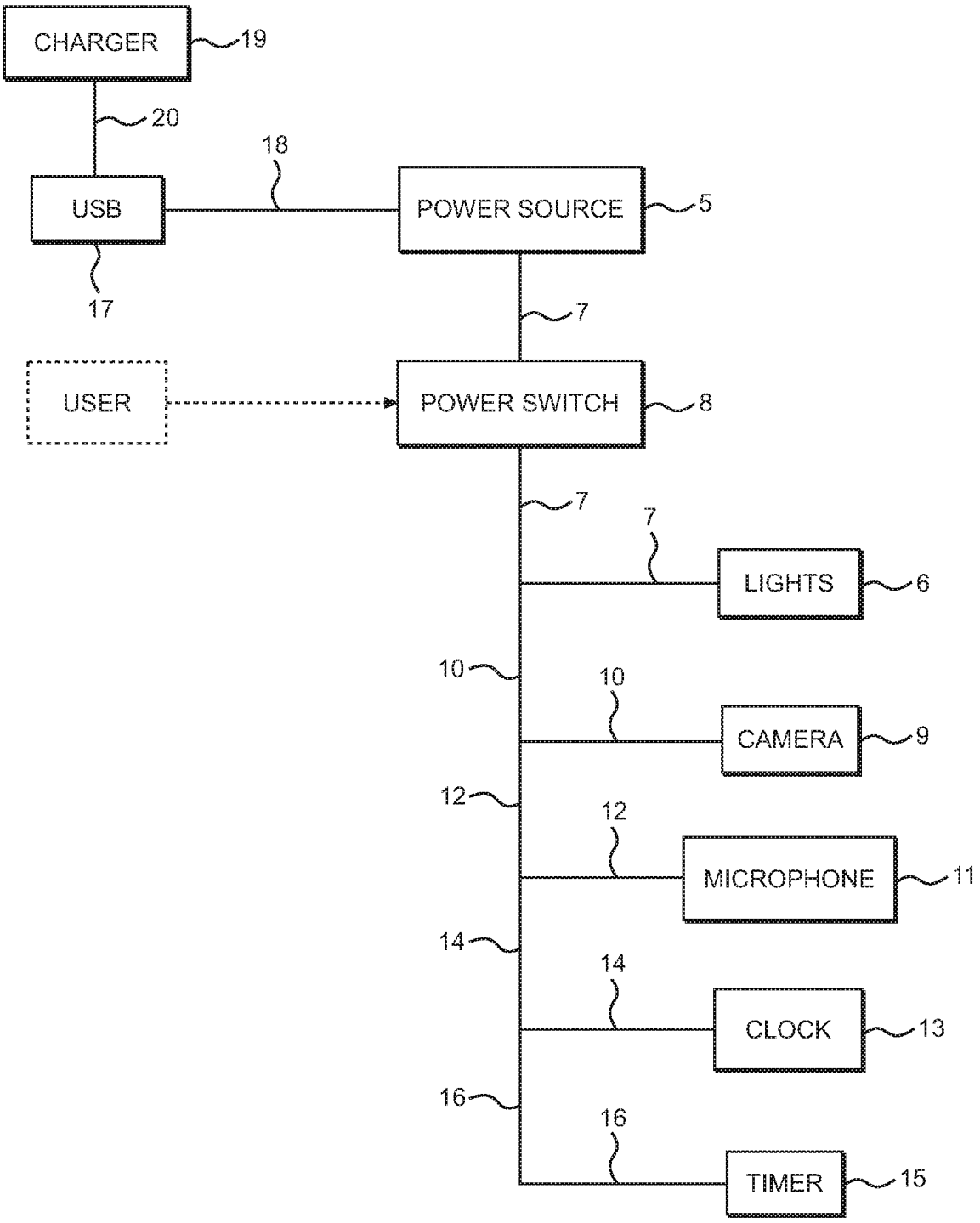
FIG. 11 depicts a diagram of a set of components of an exemplary embodiment of the illuminated accessory.

Referring now to FIGS. 1, 2, 4, and 11, there are depicted a front perspective view (FIG. 1), a rear view (FIG. 2), and a side view (FIG. 4) of an exemplary first embodiment of an illuminated accessory, having a plurality of electric lights configured to emit light from a forward side and a rearward side of the housing, and a diagram of a set of components of an exemplary embodiment of the illuminated accessory (FIG. 11).

In the shown embodiment, the illuminated accessory 1 includes a housing 2 reversibly connectable at a first end 3 thereof to a second end 4 thereof, a power source 5 disposed in the housing 2, and a plurality of electric lights 6 attached to the housing 2, wherein the plurality of electric lights 6 is operably connected to the power source 5 by an electrical connection 7. A power switch 8 is included and configured to actuate the electrical connection 7.

In the shown embodiment, the first end 3 of the housing 2 is reversibly connected to the second end 4 of the housing 2, the housing 2 is circular, and a circumference of the housing 2 is proportionate to a circumference of at least one item selected from a group including, but not limited to: a hair trimmer, and a wrist of an individual. Generally, the reversible connection between the first end 3 and the second end 4 may be according to any suitable means or mechanism for connecting two items, including a buckle, a button, a hook-and-loop, a magnet, a clip, a clasp, a connectable strap, or any other means for a reversible connection appropriate for a particular design or application. In this manner, the housing 2 is able to be fitted and removably secured to any of a plurality of items, including one or more hand-held items, and including the wrist of the individual. In this manner, the illuminated accessory 1 is multi-functional and is able to provide artificial light to the individual performing any of a variety of tasks or activities.

In some embodiments, a circumference of the housing 2 is proportionate to a circumference of a hair trimmer. In this manner, the housing 2 is proportioned to enable the illuminated accessory 1 to be easily attached to, and removed from, the hair trimmer. Also in this manner, the illuminated accessory 1 may be used as a source of artificial light when trimming hair. In some embodiments, the circumference of the housing 2 is proportionate to a circumference of the wrist of the individual, and the housing 2 is proportioned to enable the illuminated accessory 1 to be easily attached to, and removed from, the wrist of the individual. As such, the illuminated accessory 1 may be used as a source of artificial light when light is needed near a hand of the individual.

In the shown embodiment, the housing 2 includes an inner side 23, and an outer side 24, each of which has a depth that is greater than a thickness of the forward side 21 and the rearward side 22. In this manner, a set of components inside the housing 2 is able to be fitted and arranged according to a particular application. In alternate embodiments, the depth of each of the inner side 23 and the outer side 24 is equal to or less than the thickness of the forward side 21 and the rearward side 22. In this manner, a set of components inside the housing 2 is able to be fitted and arranged according to another particular application.

In particular embodiments, the housing 2 is elastic. In some embodiments, the housing 2 may be continuous, without a break or an interruption in a structure of the housing 2; the housing 2 may not include a reversible connection between a first end thereof and a second end thereof. In these embodiments, a degree of an elasticity of the housing 2 may be configured to enable the housing 2 to be expanded to fit over the hand of the individual, and retracted to rest or fit around the wrist of the individual. Generally, in these embodiments, the degree of the elasticity of the housing 2 may be configured to enable the housing 2 to be expanded to fit over a wider portion of an object, and retracted to rest or fit around a smaller portion of the object, as would be understood by a person having ordinary skill in the art.

In the shown embodiment, the plurality of electric lights 6 is included on both a forward side 21 and a rearward side 22 of the housing 2. In this manner, a total amount of light capable of being emitted from the illuminated accessory 1 may be maximized, and the overall field that may be illuminated is also maximized. In certain embodiments, the illuminated accessory 1 is configured to enable an individual to selectively control or actuate one or more electric lights of the plurality of electric lights 6, including those electric lights on the forward side 21, those electric lights on the rearward side 22, or a combination thereof. One or more electric lights of the plurality of electric lights 6 may emit a narrow light field, an intermediate light field, or a wide light field, or any combination thereof, according to design or need for a particular application. Any pattern or sequence of illumination may be designed as part of a logic and/or a circuitry of the present invention; in this manner, one or more electric lights of the plurality of lights 6 may be capable of being dimmed, brightened, blinked in any pattern (e.g., regular or irregular) or frequency (e.g., slow, medium, fast, or any combination thereof), or alternate or transition between one or more colors or states.

Figure 3:
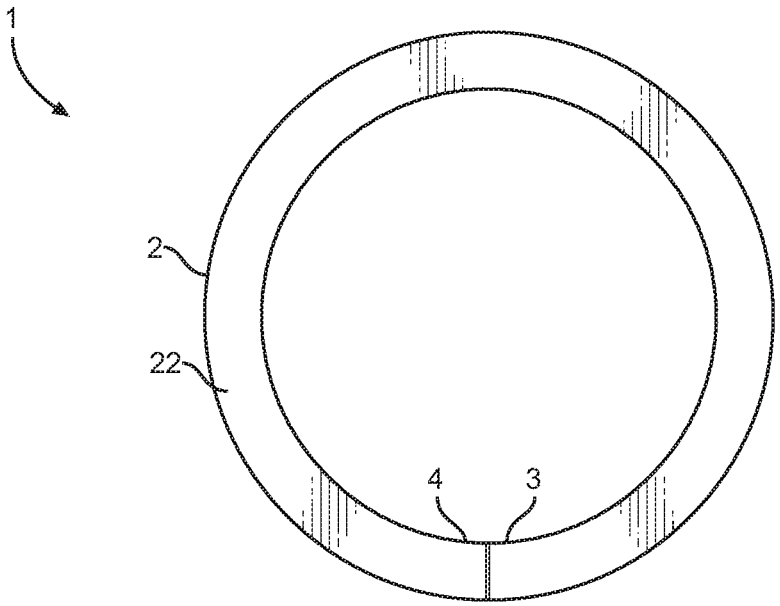
FIG. 3 depicts a rear view of an alternate exemplary first embodiment of the illuminated accessory, having a plurality of electric lights configured to emit light from a forward side of the housing, wherein the plurality of electric lights is not configured to emit light from a rearward side of the housing.
Figure 4:
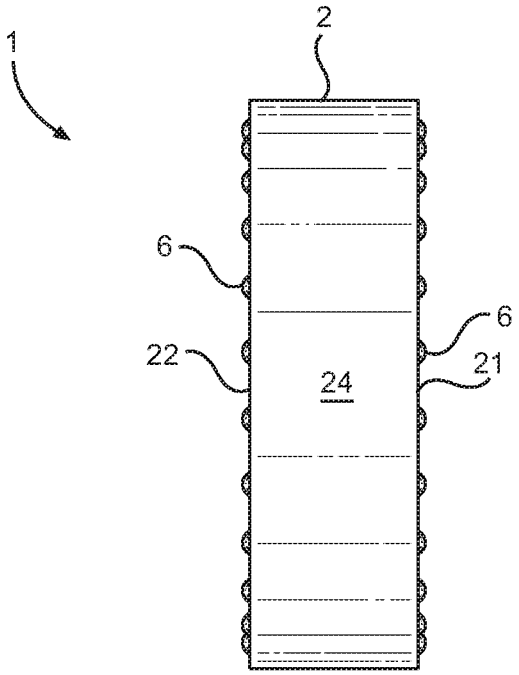
FIG. 4 depicts a side view of the exemplary first embodiment of the illuminated accessory, having a plurality of electric lights configured to emit light from the forward side and the rearward side of the housing.
Figure 5:
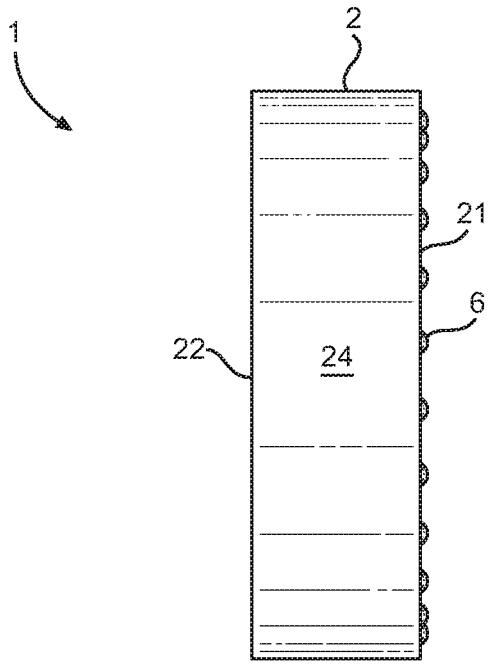
FIG. 5 depicts a side view of the alternate exemplary first embodiment of the illuminated accessory, having the plurality of electric lights configured to emit light from the forward side of the housing, wherein the plurality of electric lights is not configured to emit light from the rearward side of the housing.

Referring now to FIGS. 3, and 5, there are depicted a rear view (FIG. 3), and a side view (FIG. 5) of an alternate exemplary first embodiment of the illuminated accessory, having a plurality of electric lights configured to emit light from a forward side of the housing. In the shown embodiment, the plurality of electric lights 6 is included on only a forward side 21 of the housing 2. In this manner, an amount of light capable of being emitted from the illuminated accessory 1 may be fixed or focused in a forward direction, and the overall field that may be illuminated may be controllable or limited to a particular area or direction during use.

Figure 6:
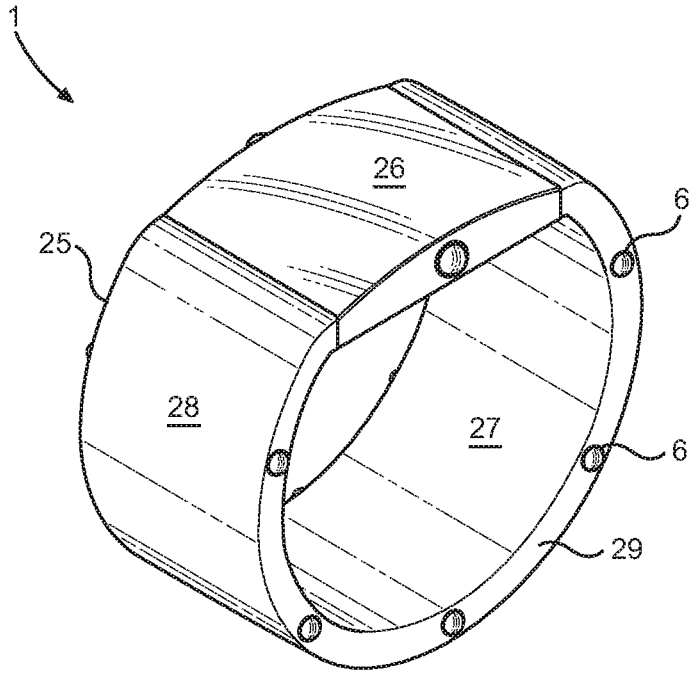
FIG. 6 depicts a front perspective view of an exemplary second embodiment of an illuminated accessory, having a plurality of electric lights configured to emit light from a forward and a rearward side of the housing.
Figure 7:
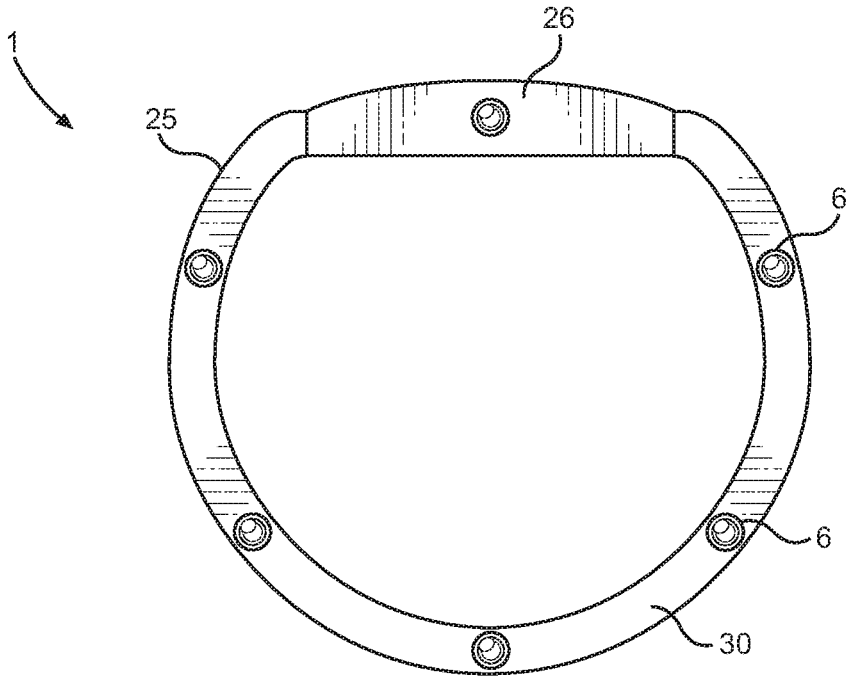
FIG. 7 depicts a rear view of the exemplary second embodiment of the illuminated accessory, wherein the plurality of electric lights is also configured to emit light from a rearward side of the housing.
Figure 9:
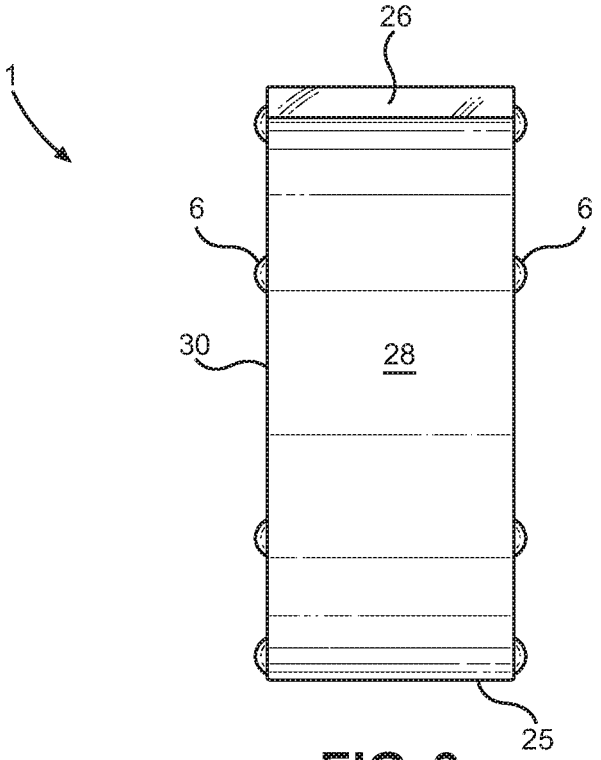
FIG. 9 depicts a side view of the exemplary second embodiment of the illuminated accessory, having a plurality of electric lights configured to emit light from the forward side and the rearward side of the housing.

Referring now to FIGS. 6, 7, and 9, there are depicted a front perspective view (FIG. 6), a rear view (FIG. 7), and a side view (FIG. 9) of an exemplary second embodiment of an illuminated accessory, having a plurality of electric lights configured to emit light from the forward side and the rearward side of the housing.

In the shown embodiment, the illuminated accessory 1 includes a housing 25, a power source 5 disposed in the housing 25, and a plurality of electric lights 6 attached to the housing 25, wherein the plurality of electric lights 6 is operably connected to the power source 5 by an electrical connection 7. A power switch 8 is included and configured to actuate the electrical connection 7.

In the shown embodiment, the housing 25 includes a mostly flat section 26 connected on opposing ends thereof to a semi-circular section having an inner surface 27 and an outer surface 28, forming a substantially or mostly circular housing 25. A circumference of the housing 25 may be proportionate to a circumference of at least one item selected from a group including, but not limited to: a hair trimmer, and a wrist of an individual. In this manner, the housing 25 is able to be fitted and removably secured to any of a plurality of items, including one or more hand-held items, and including the wrist of the individual. In this manner, the illuminated accessory 1 is multi-functional and is able to provide artificial light to the individual performing any of a variety of tasks or activities.

In the shown embodiment, the housing 25 includes the inner side 27, and the outer side 28, each of which has a depth that is greater than a thickness of a forward side 29 and a rearward side 30 of the housing 25. In this manner, a set of components inside the housing 25 is able to be fitted and arranged according to a particular application. In alternate embodiments, the depth of each of the inner side 27 and the outer side 28 is equal to or less than the thickness of the forward side 29 and the rearward side 30. In this manner, a set of components inside the housing 25 is able to be fitted and arranged according to another particular application.

In particular embodiments, the housing 25 is elastic. In the shown embodiment, the housing 25 is continuous, without a break or an interruption in a structure of the housing 25; the housing 25 may not include a reversible connection between a first end thereof and a second end thereof. In these embodiments, a degree of an elasticity of the housing 25 may be configured to enable the housing 25 to be expanded to fit over the hand of the individual, and retracted to rest or fit around the wrist of the individual. Generally, in these embodiments, the degree of the elasticity of the housing 25 may be configured to enable the housing 25 to be expanded to fit over a wider portion of an object, and retracted to rest or fit around a smaller portion of the object, as would be understood by the person having ordinary skill in the art.

In the shown embodiment, the plurality of electric lights 6 is included on both the forward side 29 and the rearward side 30 of the housing 25. In this manner, a total amount of light capable of being emitted from the illuminated accessory 1 may be maximized, and the overall field that may be illuminated is also maximized. In certain embodiments, the illuminated accessory 1 is configured to enable an individual to selectively control or actuate one or more electric lights of the plurality of electric lights 6, including those electric lights on the forward side 29, those electric lights on the rearward side 30, or a combination thereof. One or more electric lights of the plurality of electric lights 6 may emit a narrow light field, an intermediate light field, or a wide light field, according to design or need for a particular application. Any pattern or sequence of illumination may be designed into a logic and/or a circuitry of the present invention; in this manner, one or more electric lights of the plurality of lights 6 may be capable of being dimmed, brightened, or blinked in any frequency (e.g., slow, medium, fast, or any combination thereof), or alternate or transition between one or more colors or states, as explained elsewhere herein and as would be understood by the person having ordinary skill in the art.

Figure 8:
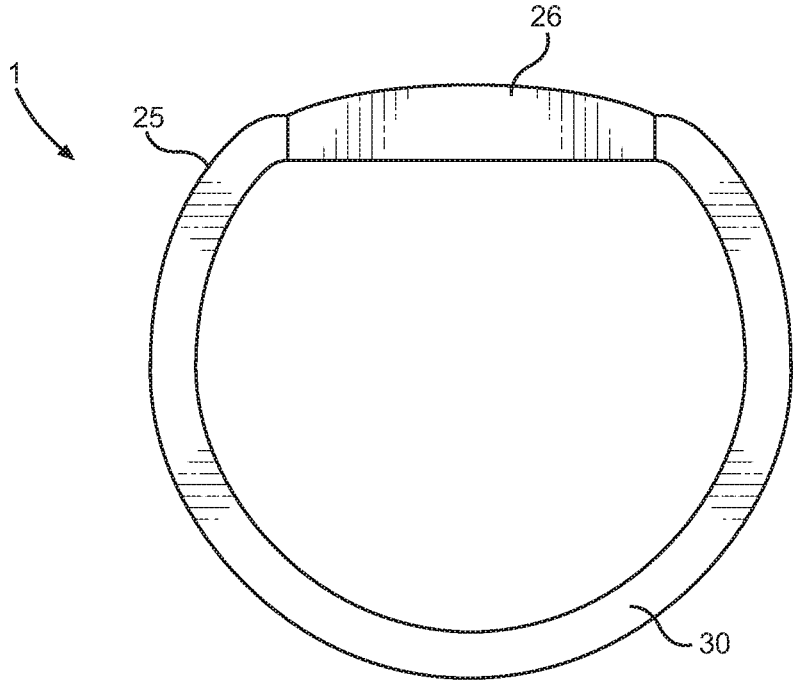
FIG. 8 depicts a rear view of an alternate exemplary second embodiment of the illuminated accessory, having a plurality of electric lights configured to emit light from a forward side of the housing, wherein the plurality of electric lights is not configured to emit light from a rearward side of the housing.
Figure 10:
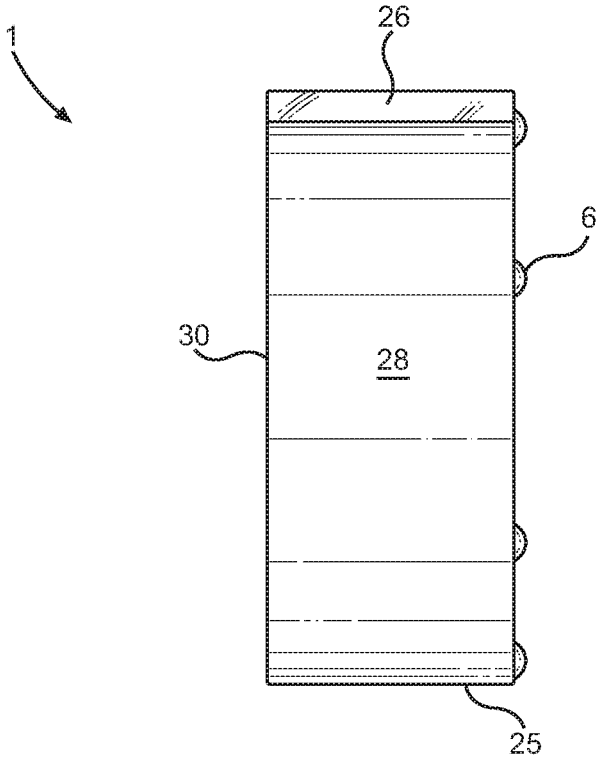
FIG. 10 depicts a side view of the alternate exemplary second embodiment of the illuminated accessory, having the plurality of electric lights configured to emit light from the forward side of the housing, wherein the plurality of electric lights is not configured to emit light from the rearward side of the housing.

Referring now to FIGS. 8, and 10, there are depicted a rear view (FIG. 8), and a side view (FIG. 10) of an alternate exemplary second embodiment of the illuminated accessory, having a plurality of electric lights configured to emit light from a forward side of the housing. In the shown embodiment, the plurality of electric lights 6 is included on only the forward side 29 of the housing 25. In this manner, an amount of light capable of being emitted from the illuminated accessory 1 may be directed, fixed, or focused in a forward direction, and the overall field that may be illuminated may be controllable.

Referring now to FIG. 11, there is depicted a diagram of a set of components of an exemplary embodiment of the illuminated accessory. In one design of the invention, the power switch 8 is operably positioned and connected to actuate the electrical connection 7. In alternate designs of the invention, the power switch 8 may be operably positioned and connected to actuate one or more of: an electrical connection 10, an electrical connection 12, an electrical connection 14, and an electrical connection 16. As explained elsewhere herein, a plurality of components, including the plurality of electric lights 6, one or more cameras 9, one or more microphones 11, one or more clocks 13 (optionally having a display, such as a digital display, in operable communication therewith), and one or more timers 15 (also optionally having a display, such as a digital display, in operable communication therewith) may be included in a design of the invention.

Because it may be desirable that one or more of the plurality of components be controllable (e.g., actuatable) independent of one or more other components of the plurality of components, it is envisioned that additional power switches 8 may be included in certain or particular embodiments of the present invention. For example, there may be five power switches 8 (one for each of electrical connections 7, 10, 12, 14, and 16), four power switches 8 (one for each of four of electrical connections 7, 10, 12, 14, and 16), three power switches 8 (one for each of three of electrical connections 7, 10, 12, 14, and 16), two power switches 8 (one for each of two of electrical connections 7, 10, 12, 14, and 16), or one power switch 8 (one for only one of electrical connections 7, 10, 12, 14, and 16). As would be understood by the person having ordinary skill in the art, alternate designs for the organization, arrangement, function, or operation of one or more of the plurality of components are envisioned and encompassed by the present invention, including changes in circuit and/or logic design, selection of particular components to achieve the functions or operations disclosed herein, and the like.

In some embodiments, the illuminated accessory 1 includes a camera 9, connected to the housing (2, 25). The camera 9 is operably connected to the power source 5 by at least the electrical connection 10. An operation of the camera 9 is controlled by one or more power switches 8, and optionally, by additional controls for initiating and concluding a recording function or activity of the camera 9. In some embodiments, the illuminated accessory 1 includes a microphone 11, connected to the housing (2, 25). The microphone 11 is operably connected to the power source 5 by at least the electrical connection 12. An operation of the microphone 11 is controlled by one or more power switches 8, and optionally, by additional controls for initiating and concluding a recording function or activity of the microphone 11. In this manner, the individual can record audio and/or visual data, during a use of the illuminated accessory 1, for storage, copying, transfer, playback, archiving, and deletion, as needed.

In some embodiments, the illuminated accessory 1 includes a clock 13, connected to the housing (2, 25). The clock 13 is operably connected to the power source 5 by at least the electrical connection 14. An operation of the clock 13 is controlled by one or more power switches 8, and optionally, by additional controls for setting, changing, programming, altering, or customizing the clock 13 or a display thereof. In some embodiments, the illuminated accessory 1 includes a timer 15, optionally as a programmable functionality of the clock 13, also connected to the housing (2, 25). The timer 15 is operably connected to the power source 5 by at least the electrical connection 16. An operation of the timer 15 is controlled by one or more power switches 8, and optionally, by additional controls for setting, changing, programming, altering, or customizing the timer 15 or a display thereof. In some embodiments, the illuminated accessory 1 includes at least one display for displaying a time of the clock 13 and/or a time of the timer 15. In this manner, the individual can check a time of a day, or a time of a use of the illuminated accessory 1, or any other time or measurement thereof.

In some embodiments, the illuminated accessory 1 includes a universal serial bus (USB) interface 17 connected to and/or embedded in the housing 2, operably connected to at least the power source 5 by an electrical connection 18. In this manner, the power source 5 may be recharged by connecting a charger 19 to the USB interface 17 by an electrical connection 20.

In some embodiments, the illuminated accessory 1 includes one or more non-transitory data storage mediums for storing data obtained by any one or more of the plurality of components, including the camera 9, the microphone 11, the clock 13, the timer 15, or any combination or variation thereof. In addition, in some embodiments, the illuminated accessory 1 includes one or more additional computing components, including but not limited to a processor, a motherboard, a memory, and a programmable logic stored in the memory. As such, performance of a task or function by the illuminated accessory 1 (e.g., activation or deactivation of lights 6, camera 9 and/or microphone 11, or clock 13 and/or timer 15) may be initiated and/or completed by an action or an input originating from the individual and/or the environment. For example, selection of a function, operation, or task of the illuminated accessory 1 may be made by the individual, and alternatively or in addition to the selection of the individual, a particular condition or set of conditions may be necessary or sufficient to perform the task or function (e.g., the environment is dim or dark so the lights 6 are activated). Accordingly, design of the components, including the programmable logic, may be performed to enable the individual to utilize the illuminated accessory 1 in highly unique or customizable ways. In this manner, a utility of the illuminated accessory 1 is maximized.

The USB interface 17 may be operably connected to one or more of the data storage mediums, thereby enabling a copying, a transfer, and/or a management of the data stored on the non-transitory data storage medium by an external computational device (e.g., a personal computer, a tablet, a cellular telephone, a mobile device, a tablet, etc.).

In some embodiments, the power source 5 includes an electric battery. In some embodiments, the electric battery is rechargeable. In this manner, the electric battery does not need to be disposed after a single use. Similarly, in this manner, the illuminated accessory 1 does not need to be disposed after a single use.

In some embodiments, the plurality of electric lights 6 is configured to emit light from a forward side (21, 29) of the housing (2, 25). In this manner, the illuminated accessory 1 emits light from one side of the housing (2, 25), thereby directing the light in one broad or focused direction, and preserving an energy of the power source 5.

In some embodiments, the plurality of electric lights 6 is configured to emit light from the forward side (21, 29) and the rearward side (22, 30) of the housing (2, 25). In this manner, the illuminated accessory 1 emits light from two sides of the housing (2, 25), thereby spreading the emitted light in two directions in a broad or focused manner, and increasing an amount of light provided to an environment.

Selection of particular or suitable materials and/or components may vary depending on design choice or situational necessity. As described elsewhere herein, the power source 5 may include any suitable power source, including a battery, or a rechargeable battery. The electrical connection 7 may include any suitable electrical wire, cable, or cord. The plurality of electric lights 6 may include one or more light-emitting diodes (LEDs). One or more electric lights of the plurality of electric lights 6 may emit light of any color, including but not limited to white, red, orange, yellow, green, blue, indigo, violet, and any intermediate, derivative, variation, or combination thereof, in any intensity according to preference or necessity for a particular application of the illuminated accessory 1. In this manner, the illuminated accessory 1 is useful as a source of artificial light in any setting, including a well-lit setting, an average-lit setting, or a low-lit or dimly-lit setting, or a completely dark setting, or any intermediate thereof.

The power switch 8 includes any suitable electric switch that may be accessible to the individual, who may manually activate or deactivate one or more electrical connections of the invention by switching one or more power switches 8 to an "on" configuration or setting, or to an "off" configuration or setting. Exemplary power switches include, but are not limited to: a button, a toggle switch, a position switch, a motion-activated switch, a motion-deactivated switch, a motion-controlled switch, an audio-controlled switch, a light-controlled switch, and any derivative, variation, or combination thereof.

The power switch 8 may be physically positioned on either the exterior of the housing (2, 25), or in the interior of the housing (2, 25), according to any design need or preference. If the power switch 8 is disposed in the interior of the housing (2, 25), appropriate measures may be engineered to ensure access to the power switch 8 by the individual using the illuminated accessory 1. For example, if the power switch 8 is a pressure-controlled button, it may be depressed or actuated by applying a pressure to the exterior of the housing (2, 25), which in turn depresses (e.g., in a concave manner) to transfer pressure or force to the power switch 8, thereby actuating the power switch 8 (e.g., the housing (2, 25) may be elastic to enable depression of the power switch 8 thereunder). In this manner, by use of the power switch 8, the illuminated accessory 1 only consumes energy from the power source 5 as needed or during use of the illuminated accessory 1, reducing or eliminating waste of energy of the power source 5.

In particular or preferred embodiments, the housing (2, 25) is elastic. In such embodiments, the housing (2, 25) may or may not be reversibly connectable at a first end thereof to a second end thereof, and as such, if the housing (2, 25) is in a circular or substantially circular configuration, the housing (2, 25) may be discrete (i.e., having the reversible connection between two portions thereof), or may be continuous (i.e., not having the reversible connection between two portions thereof). Materials and designs suitable for elastic housings of the present invention include, but are not limited to, a natural or synthetic rubber, a polymer such as a flexible polymer, a series of interconnected units biased toward a retracted configuration (e.g., as may be utilized in designing bracelets or wrist watches, or the like), and any other suitable materials and/or designs, as would be understood by the person having ordinary skill in the art.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the instant invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. An illuminated accessory, comprising consisting of:

a housing having a front side disposed orthogonally to an inner side;

a power source disposed in the housing;

a plurality of electric lights attached to the housing on the front side thereof such that light emitted from the plurality of lights is directed along an axis parallel to the inner side;

wherein the plurality of electric lights is operably connected to the power source by an electrical connection; and a power switch configured to actuate the electrical connection.

* * * * *